US005924556A

United States Patent [19]

Kawase et al.

[11] Patent Number: 5,924,556

[45] Date of Patent: Jul. 20, 1999

[54] PUSH SWITCH DEVICE

[75] Inventors: Tatsuaki Kawase; Eiji Kimura, both of Miyagi-ken, Japan

[73] Assignee: Alps Electric Co., Ltd., Tokyo, Japan

[21] Appl. No.: 09/162,043

[22] Filed: Sep. 28, 1998

[30] Foreign Application Priority Data

Oct. 6, 1997 [JP] Japan ..... 9-272800

[51] Int. Cl.[6] ..... H01H 13/56

[52] U.S. Cl. ..... 200/523; 200/525

[58] Field of Search ..... 200/16 R, 16 B, 200/16 C, 16 D, 520, 521, 523, 525, 529, 533, 341

[56] References Cited

U.S. PATENT DOCUMENTS

| | | | |
|---|---|---|---|
| 3,619,528 | 11/1971 | Sorenson | 200/153 J |
| 4,204,102 | 5/1980 | Bull | 200/153 J |
| 4,300,026 | 11/1981 | Bull | 200/153 J |
| 4,736,081 | 4/1988 | Sorrells | 200/160 |
| 5,136,132 | 8/1992 | Kitchen | 200/525 |
| 5,508,485 | 4/1996 | Nishikawa | 200/525 |
| 5,521,347 | 5/1996 | Imaeda et al. | 200/525 |

*Primary Examiner*—Michael A. Friedhofer
*Attorney, Agent, or Firm*—Brinks Hofer Gilson & Lione

[57] ABSTRACT

A push switch including a rotatably supported movable contact member with a movable contact portion which comes into contact with and separates from a stationary contact; and a cam shaft rotatably disposed between the lower surface of a plunger and the movable contact member. The switching driver portion of the cam shaft slides on the movable contact member. The force used to push down the plunger is exerted on the movable contact member through the switching driver portion to tilt the movable contact member. The push switch also includes a switching guide protrusion, which is provided at the movable contact member, for always guiding the switching driver portion of the cam shaft towards the raised end portion of the movable contact member, in accordance with the direction in which the movable contact member tilts; a coil spring for biasing the cam shaft and automatically restoring it back to its original position, and for biasing the plunger upward; and a cam member which is rockably supported on the movable contact member and receives the lower end of the coil spring. The push switch is more durable and provides a more reliable contact.

1 Claim, 13 Drawing Sheets

PUSH SWITCH DEVICE

BACKGROUND OF THE INVENTION

1. Field of the Invention

The present invention relates to a push switch device whose seesaw type movable contacts are moved as a result of pushing down a plunger.

2. Description of the Related Art

A conventional push switch device of such a type is disclosed, for example, in U.S. Pat. No. 4891476, and is shown in FIG. 13.

FIG. 13 illustrates the aforementioned conventional push switch device.

Referring to FIG. 13, reference numeral 51 denotes a top case; reference numeral 52 denotes a push button that is supported at the top case 51 so as to be movable vertically; reference numeral 53 denotes a cam shaft that is inserted into a hole in the push button 51; reference numeral 54 denotes a coil spring; reference numeral 55 denotes a sliding element supporting member that is integrally fitted to the cam shaft 53; reference numeral 56 denotes a wafer with a stationary contact; reference numerals 57 denote terminals led out from a stationary contact; and reference numeral 58 denotes a base, In the switch device of FIG. 13, pushing the push button 51 against the force of the coil spring 54 causes the cam shaft 53 to rotate with its axial core as center and the sliding element supporting member 55 to rotate. Rotation of the sliding element supporting member 55 causes the sliding element to come into contact with or separate from the stationary contact, whereby an on operation or an off operation is performed.

In such a conventional switch device, however, the cam undergoes wear with use. This results in the production of powder that causes switching operation failure or the like. When medium current is used, an arc is generated during switching of contact connections. This also results in the production of powder that causes electrical connection failure.

SUMMARY OF THE INVENTION

Accordingly, it is an object of the present invention to provide a push switch device which is more durable and provides more reliable contacts.

To this end, according to the present invention, there is provided a push switch device comprising a stationary contact disposed at a case; a movable contact member which is rotatably supported at the case, the movable contact member having a movable contact which comes into contact with and separates from the stationary contact; a plunger which is supported at the case so as to be pushable downward; a cam shaft which is rotatably disposed between the lower surface of the plunger and the movable contact member, and which moves vertically as the plunger moves vertically, the cam shaft having at the lower portion thereof a switching driver portion, the switching driver portion sliding on the movable contact member so that the force used to push down the plunger causes the switching driver portion to push down and tilt the movable contact member as the cam shaft slides on the movable contact member; a switching guide protrusion, disposed at substantially the center of the upper surface of the movable contact member, for always guiding the switching driver portion of the cam shaft towards the raised end of the movable contact member, in accordance with the direction in which the movable contact member is tilted; a coil spring for biasing the cam shaft to automatically restore the cam shaft to a neutral position thereof, and for biasing the plunger upward through the cam shaft; and a cam member which is rockably supported on the movable contact member, the cam member receiving the lower end of the coil spring and tilting in a direction opposite to the direction in which the movable contact member tilts in order to bend the coil spring; wherein when the plunger is pushed down, the cam shaft, while being kept at the neutral position, moves downward, causing the switching driver portion to be guided, by the switching guide protrusion which is tilted, towards the raised end portion of the movable contact member and the cam shaft to rotate against the biasing force of the coil spring, so that the rotation of the cam shaft causes the switching driver portion to push down the raised end portion of the movable contact member and tilt the movable contact member, and, at the same time, the cam member to tilt in a direction opposite to the direction in which the movable contact member tilts, causing the coil spring to bend in order to bias the movable contact member in the direction in which the movable contact member tilts.

DESCRIPTION OF THE PREFERRED EMBODIMENT

A description will now be given of a preferred embodiment of the present invention with reference to the drawings.

Figure 1:
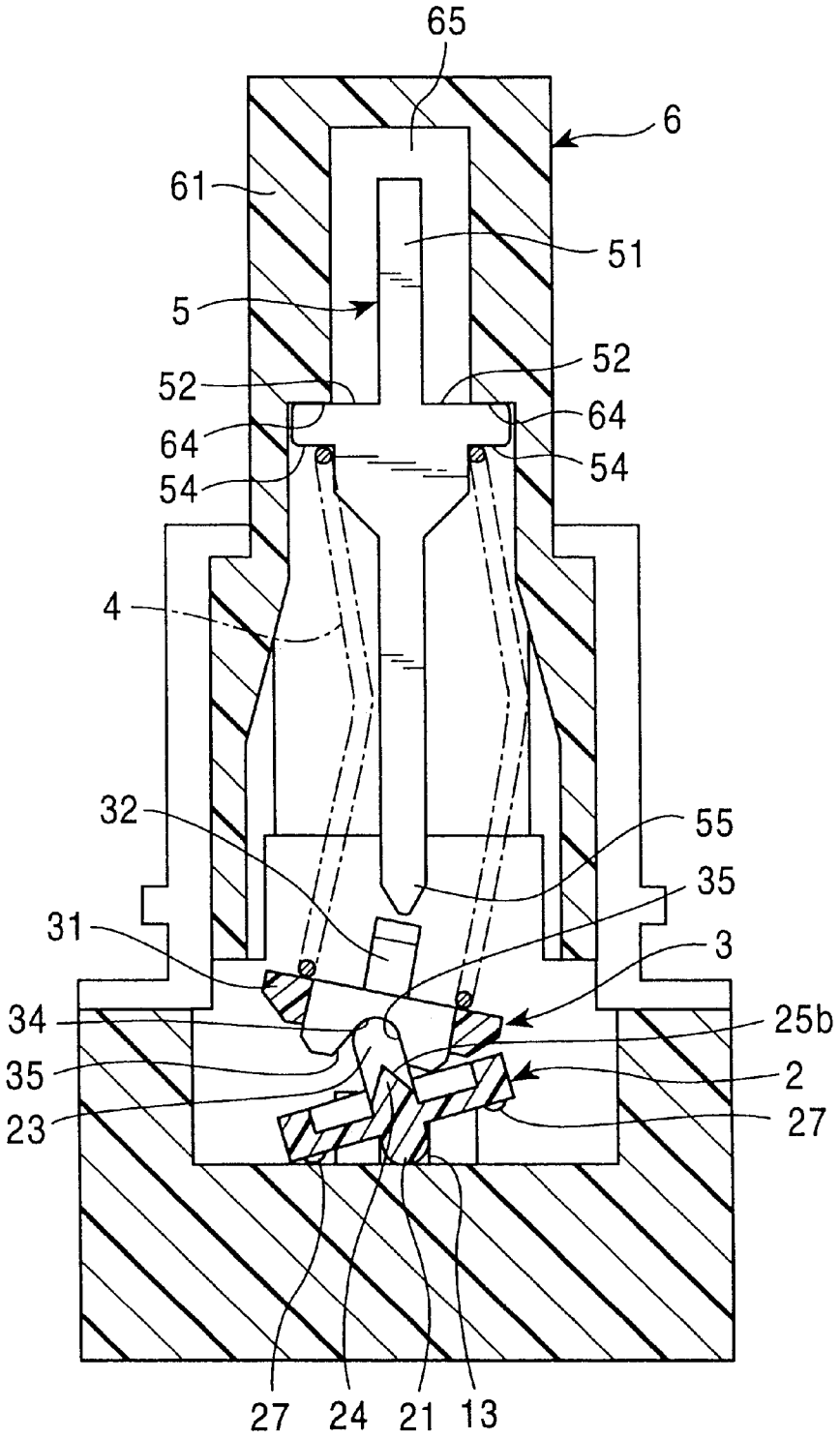
FIG. 1 illustrates an embodiment of the push switch device which is not pushed down (or which is in a "not pushed down" state), in accordance with the present invention.
Figure 2:
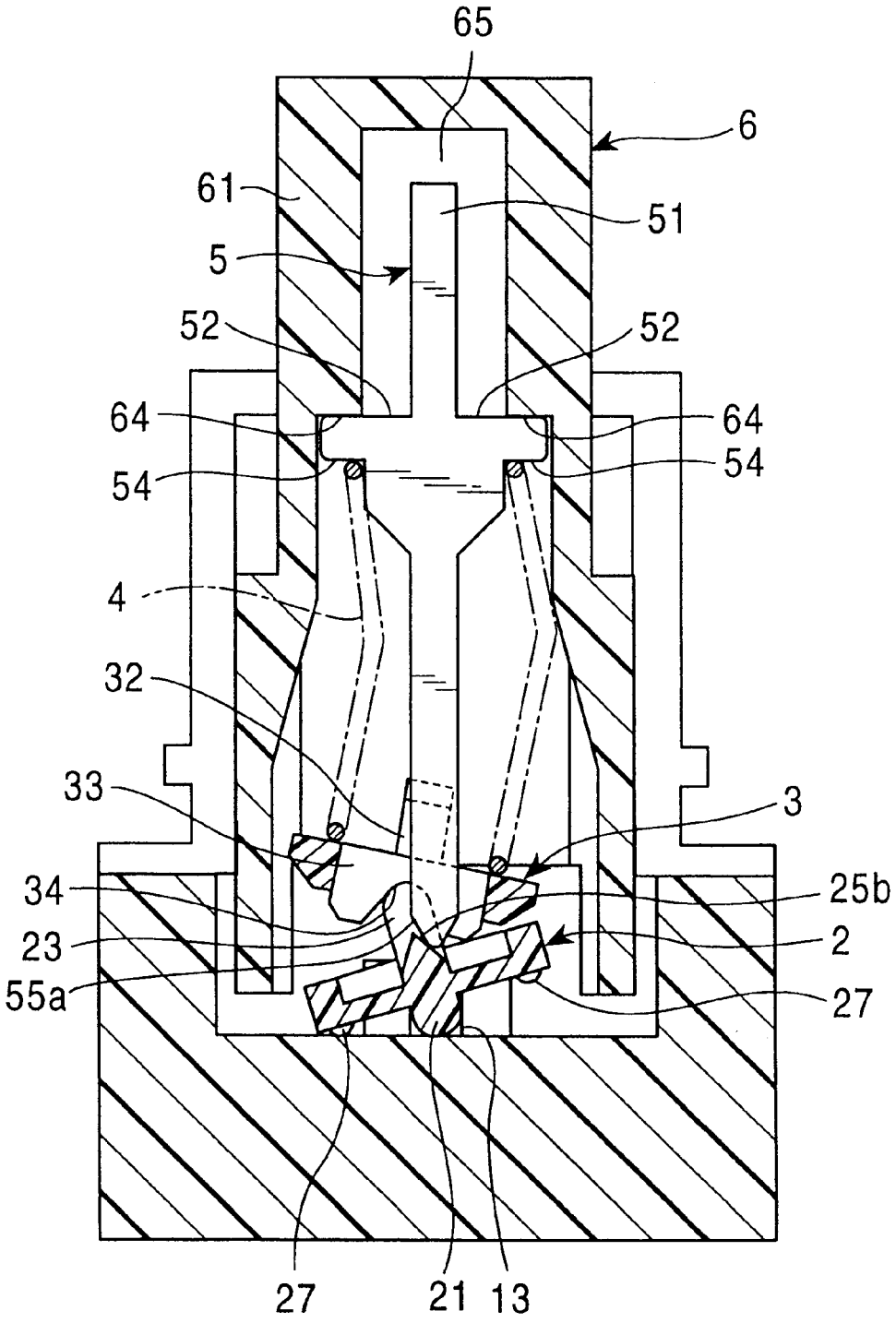
FIG. 2 illustrates the embodiment of the push switch device in a partially pushed down state, in accordance with the present invention.
Figure 3:
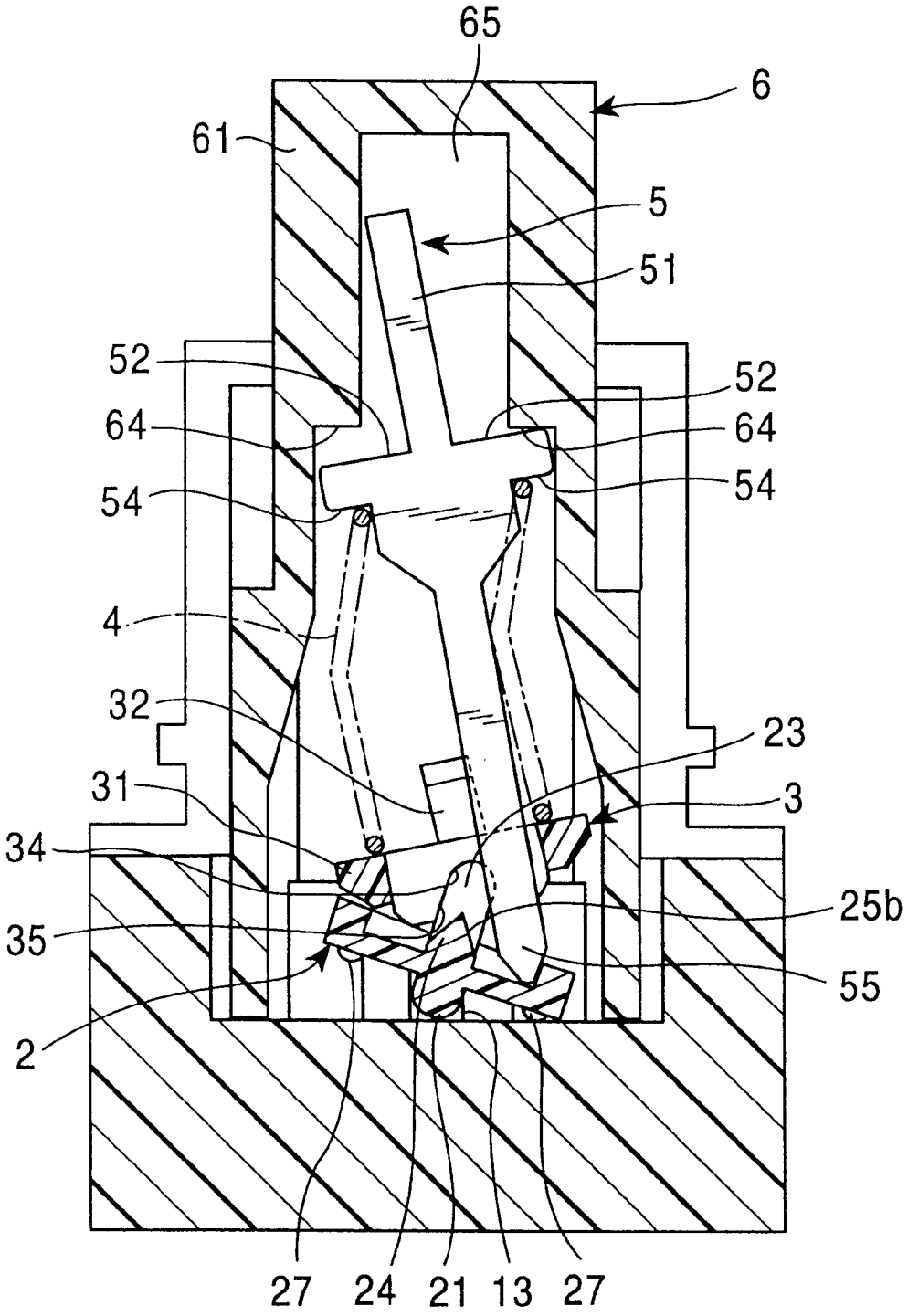
FIG. 3 illustrates the embodiment of the push switch device in a completely pushed down state, in accordance with the present invention.
Figure 4:
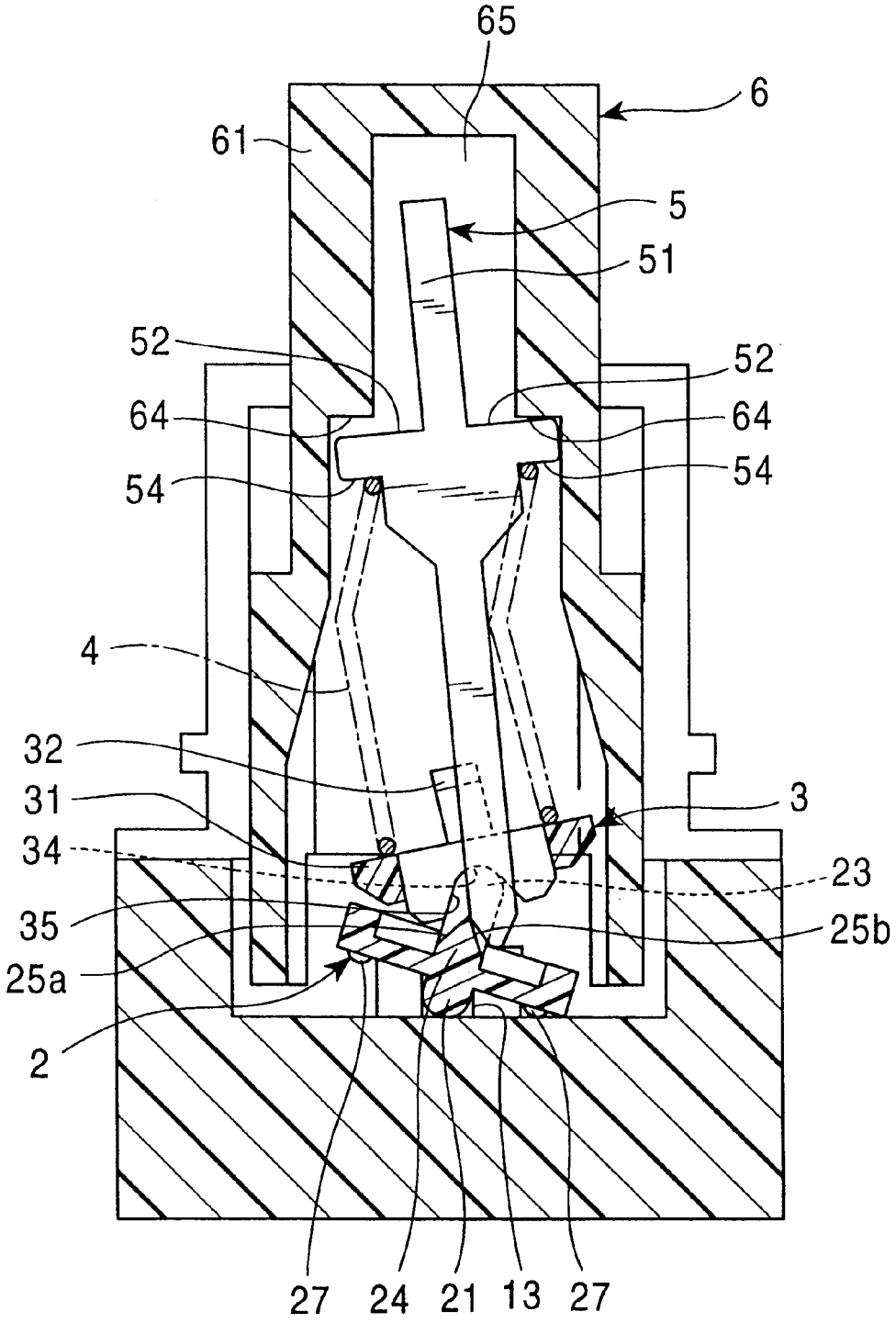
FIG. 4 illustrates the embodiment of the push switch device restored to the partially pushed down state, in accordance with the present invention.
Figure 5:
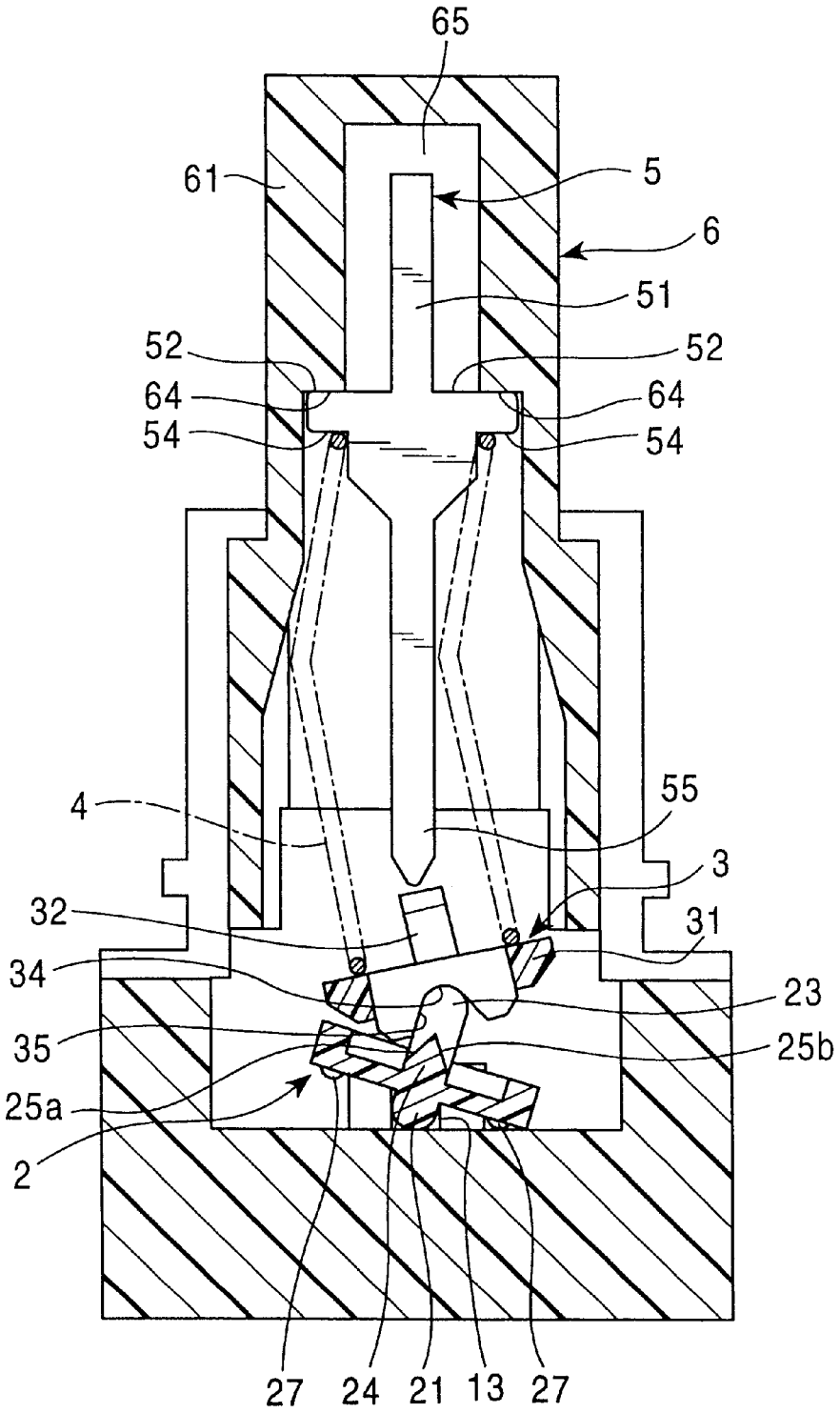
FIG. 5 illustrates the embodiment of the push switch device restored to the "not pushed down" state, in accordance with the present invention, in which switching of contact connections has been achieved.
Figure 6:
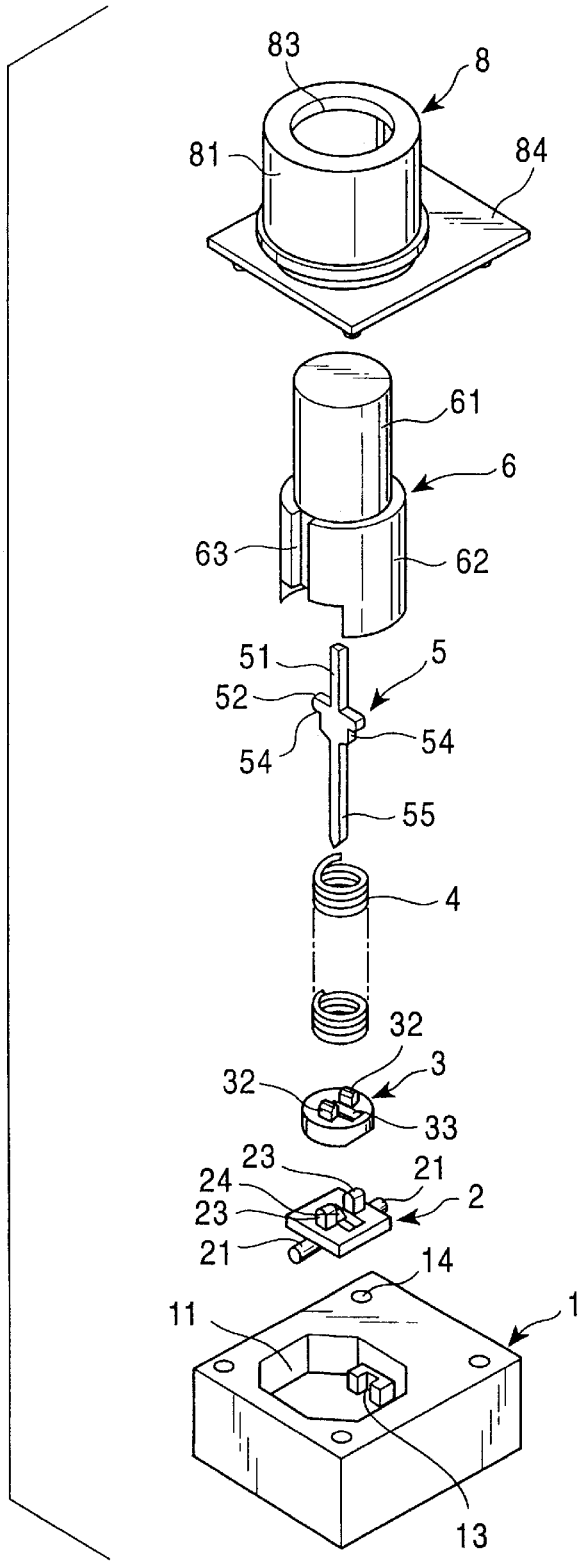
FIG. 6 is an exploded perspective view of the embodiment of the push switch device in accordance with the present invention.
Figure 7A:
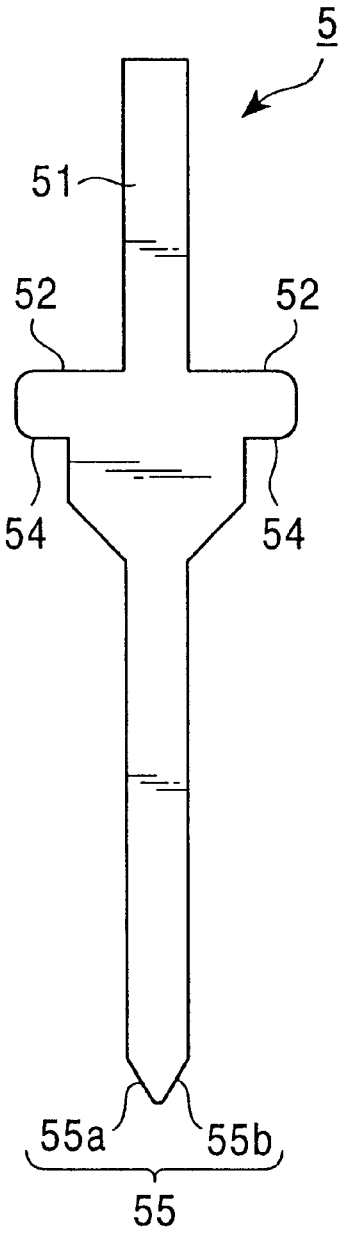
FIGS. 7A and 7B are, respectively, a front view and a right view of a cam shaft.
Figure 7B:
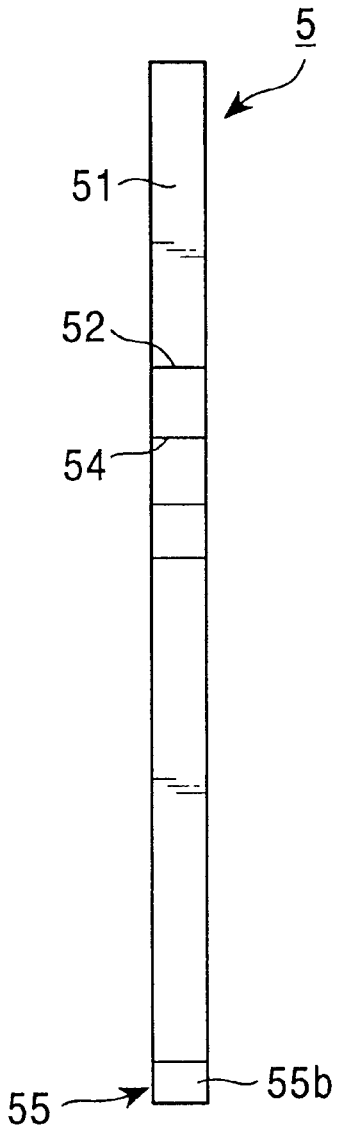
Figure 8A:
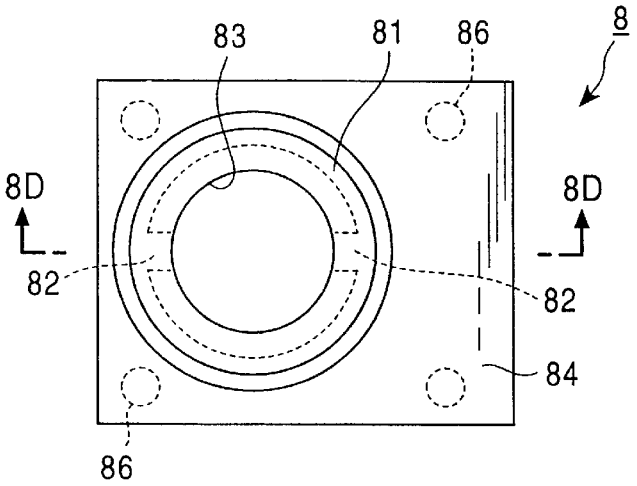
FIGS. 8A and 8B are, respectively, a plan view and a front view of an upper case portion.
Figure 8B:
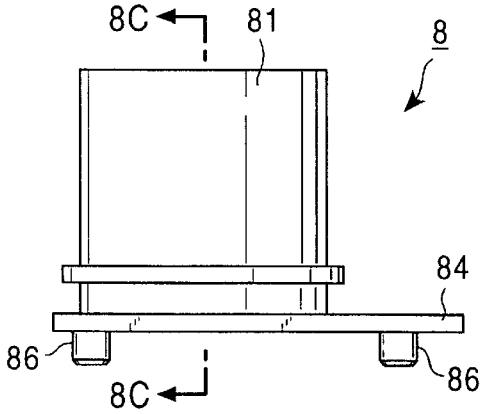
Figure 8C:
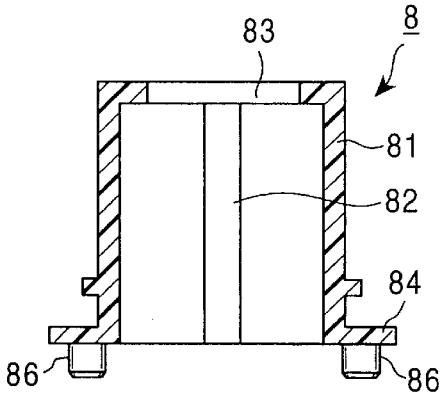
FIGS. 8C and 8D are, respectively, a sectional view taken along line 8C—8C of FIG. 8B and a sectional view taken along line 8D—8D of FIG. 8A.
Figure 8D:
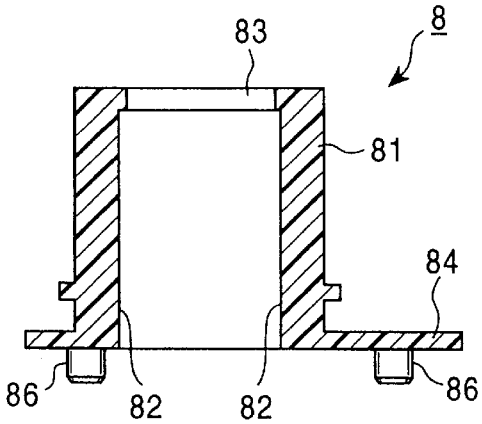
Figure 9A:
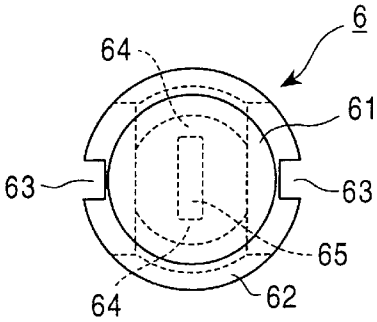
FIGS. 9A, 9B, and 9D are, respectively, a plan view, a front view, and a right view of a plunger.
Figure 9B:
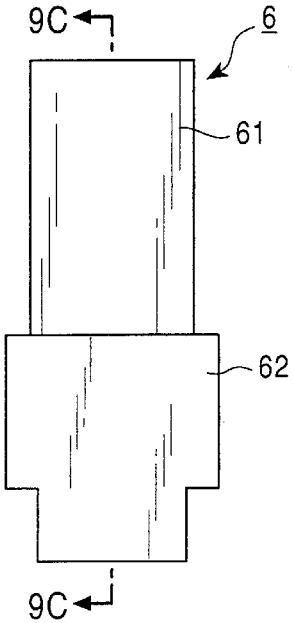
Figure 9C:
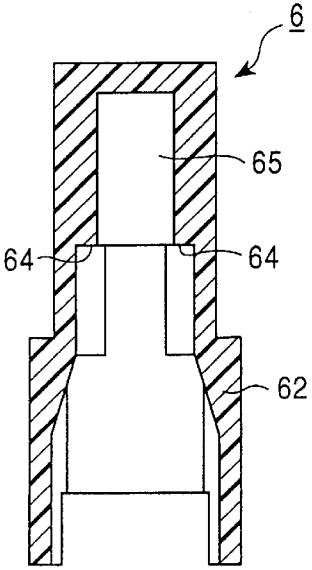
FIGS. 9C and 9E are, respectively, a sectional view taken along line 9C—9C of FIG. 9B and a sectional view taken along line 9E—9E of FIG. 9D.
Figure 9D:
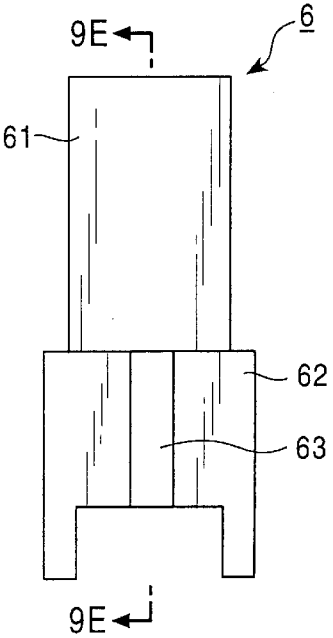
Figure 9E:
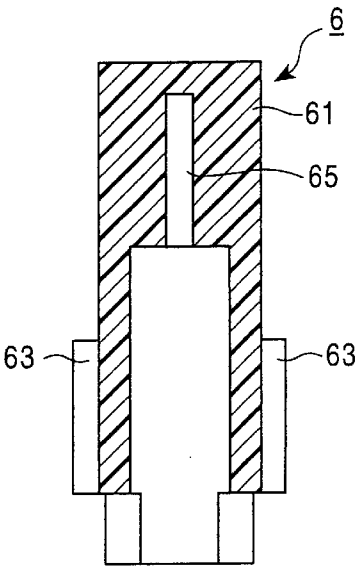
Figure 10A:
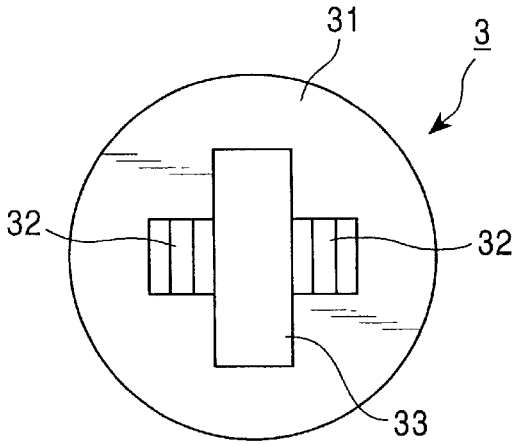
FIGS. 10A, 10B, and 10C are, respectively, a plan view, a front view, and a right view of a cam member.
Figure 10D:
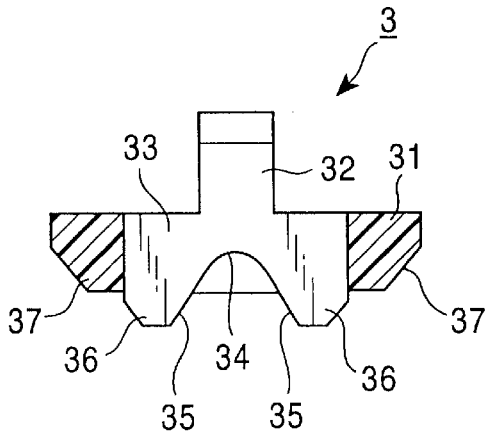
FIG. 10D is a sectional view taken along line 10D—10D of FIG. 10B.
Figure 10B:
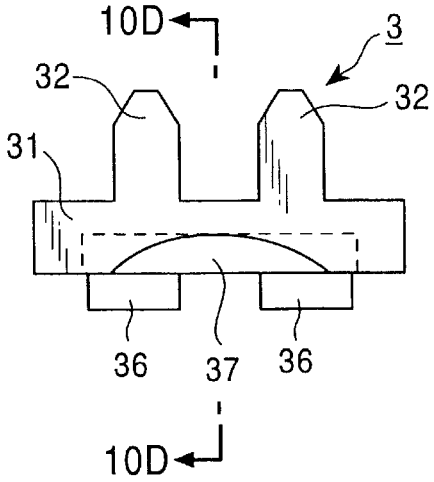
Figure 10C:
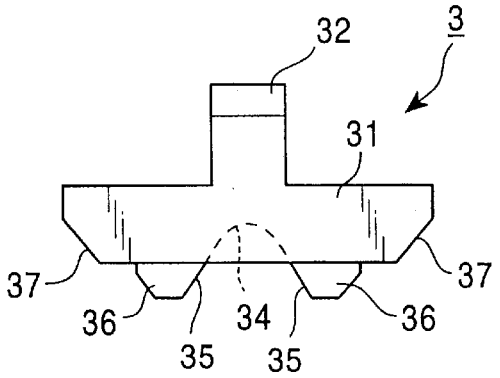
Figure 11A:
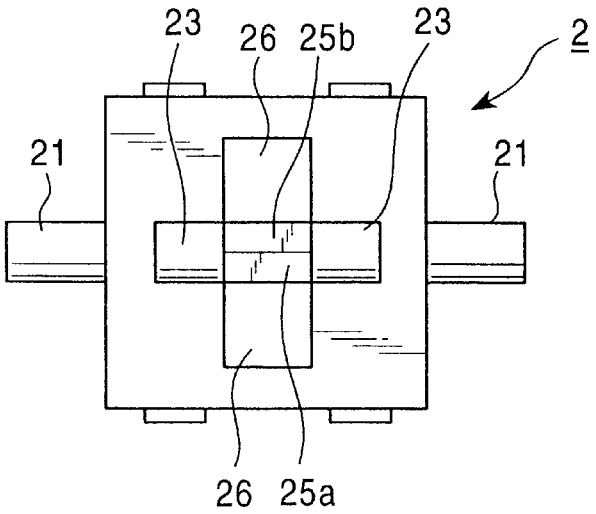
FIGS. 11A, 11B, and 11C are, respectively, a plan view, a front view, and a right view of a movable contact member.
Figure 11D:
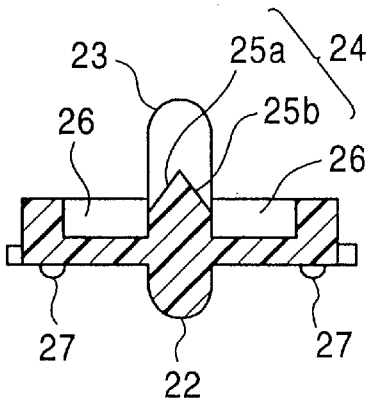
FIG.11D is a sectional view taken along line 11D—11D of FIG. 11B.
Figure 11B:
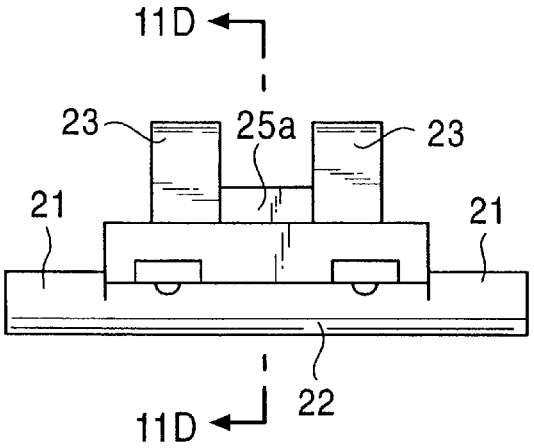
Figure 11C:
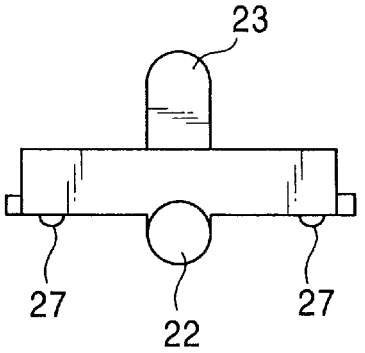
Figure 12A:
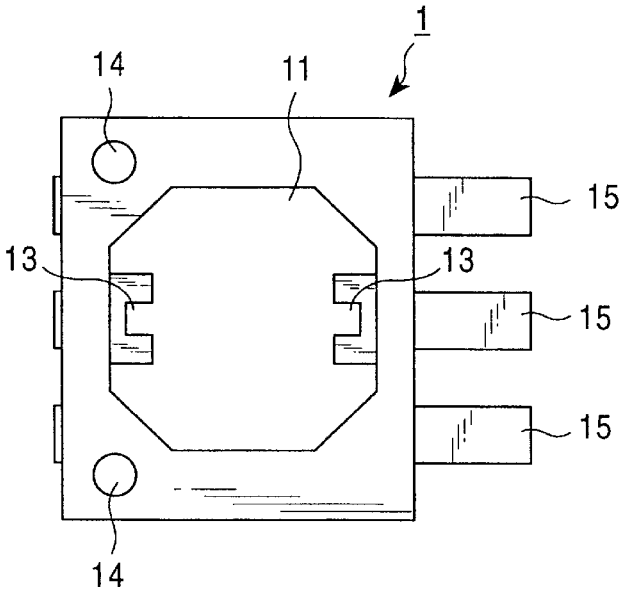
FIGS. 12A, 12B, and 12C are, respectively, a plan view, a front view, and a right view of a wafer.
Figure 12D:
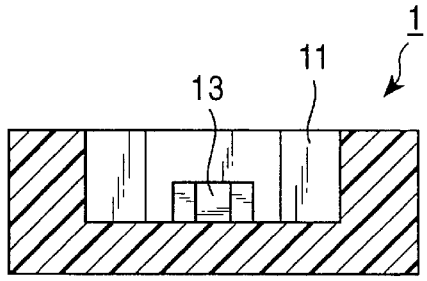
FIG. 12D is a sectional view taken along line 12D—12D of FIG. 12B.
Figure 12B:
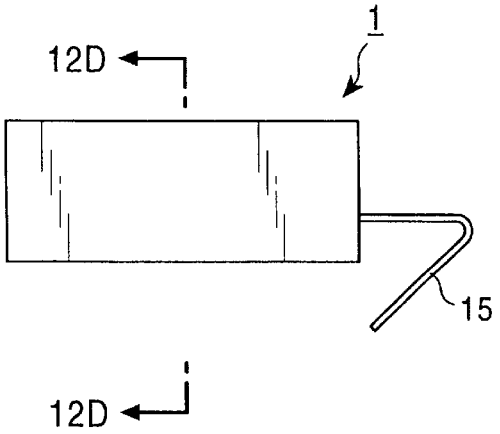
Figure 12C:
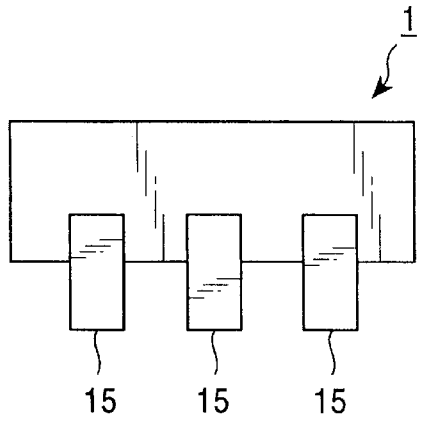
Figure 13:
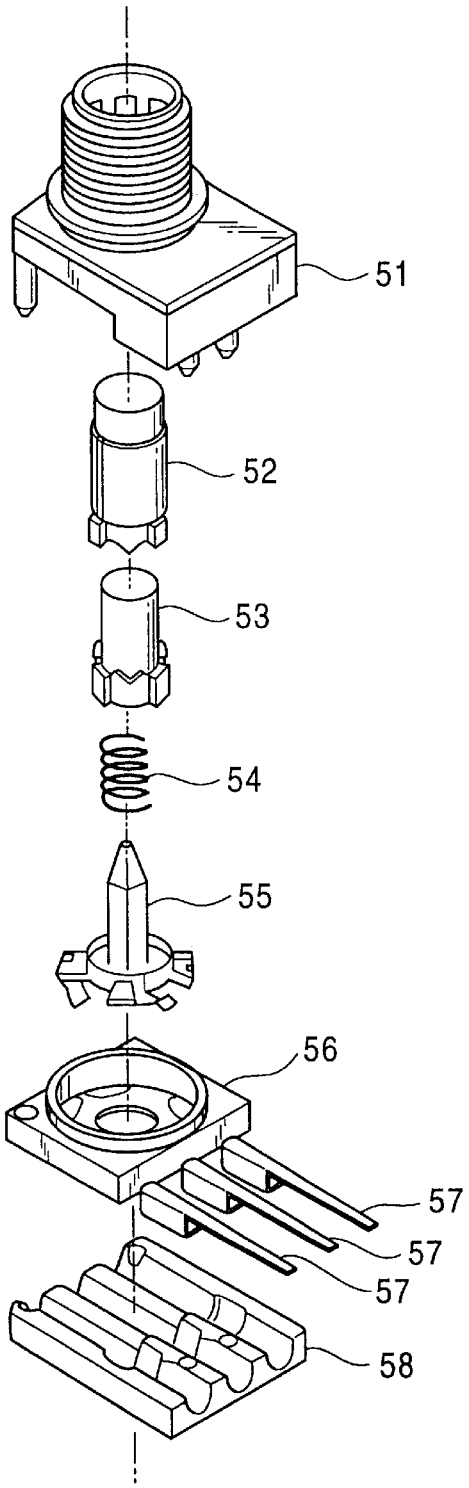
FIG. 13 PRIOR ART
FIG. 13 is an exploded perspective view of a conventional push switch device.

FIG. 1 illustrates an embodiment of the push switch device in a "not pushed down" state, in accordance with the present invention. FIG. 2 illustrates the embodiment of the push switch device in a partially pushed down state, in accordance with the present invention. FIG. 3 illustrates the embodiment of the push switch device in a completely pushed down state, in accordance with the present invention. FIG. 4 illustrates the embodiment of the push switch device restored to the partially pushed down state, in accordance with the present invention. FIG. 5 illustrates the embodiment of the push switch device restored to the "not pushed down" state in accordance with the present invention, in which switching of contact connections has been achieved. FIG. 6 is an exploded perspective view of the embodiment of the push switch device in accordance with the present invention. FIGS. 7A and 7B are, respectively, a front view and a right view of a cam shaft. FIGS. 8A and 8B are, respectively, a plan view and a front view of an upper case portion. FIGS. 8C and 8D are, respectively, a sectional view taken along line 8C—8C of FIG. 8B and a sectional view taken along line 8D—8D of FIG. 8A. FIGS. 9A, 9B, and 9D are, respectively, a plan view, a front view, and a right view of a plunger. FIGS. 9C and 9E are, respectively, a sectional view taken along line 9C—9C of FIG. 9B and a sectional view taken along line 9E—9E of FIG. 9D. FIGS. 10A, 10B, and 10C are, respectively, a plan view, a front view, and a right view of a cam member. FIG.10D is a sectional view taken along line 10D—10D of FIG.10B. FIGS. 11A, 11B, and 11C are, respectively, a plan view, a front view, and a right view of a movable contact member. FIG. 11D is a sectional view taken along line 11D—11D of FIG. 11B. FIGS. 12A, 12B, and 12C are, respectively, a plan view, a front view, and a right view of a wafer. FIG. 12D is a sectional view taken along line 12D—12D of FIG. 12B.

Referring to these figures, reference numeral 1 denotes a lower case portion (wafer), reference numeral 2 denotes a movable contact member, reference numeral 3 denotes a cam member, reference numeral 4 denotes a coil spring, reference numeral 5 denotes a cam shaft, reference numeral 6 denotes a plunger, and reference numeral 8 denotes an upper case portion.

As shown in FIGS. 12A to 12D, the lower case portion 1 is formed by molding, for example, synthetic resin into a rectangular shape. It has at the upper surface thereof a recess for accommodating therein the movable contact member 2, the cam member 3, etc. A protruding step is formed at the lower portions of both inside walls of the recess 11, with vertical grooves being formed between the opposing faces of both protruding steps to form bearing grooves 13. The shaft of the movable contact member 2 is supported in the bearing grooves 13. Reference numerals 14 denote recesses for fitting thereto positioning bosses of the upper case portion 8. Although not shown, stationary contact portions are integrally molded at the bottom surface of the recess 11 in the lower case portion 1 so as to be exposed to the outside, thereby allowing a movable contact portion at a free end of the rockably supported movable contact member 2 to come into contact with and separate from its associated stationary contact. Reference numerals 15 denote connecting terminals which have been led out from their corresponding stationary contact portions.

The movable contact member 2 is formed by molding synthetic resin to an electrically conductive terminal. As shown in FIGS. 11A to 11D, rotational shaft portions 21 protrude sideways from the center portion of the bottom surface of the movable contact member 2. A downwardly extending, protruding bar-like portion 22 is formed between the rotational shaft portions 21. It contacts the bottom surface of the recess 11 in order to support the movable contact member 2. A pair of rockably supporting protrusions 23 are formed at the center portion of the upper surface of the movable contact member 2 to rockably support the cam member 3, with the top ends thereof being formed into an arcuate shape in cross section. A switching guide protrusion 24, which is triangular in cross section, is formed at the center portion of the upper surface of the movable contact member 2 so as to be disposed between the rockably supporting protrusions 23. The tapered surfaces 25*a* and 25*b* of the switching guide protrusion 24 face their respective free ends of the movable contact member 2. Therefore, the switching drive portion of the cam shaft 5 is guided towards one of the free ends of the movable contact member 2 by the tapered surfaces 25*a* and 25*b* of the switching guide protrusion 24. A recess 26 is formed so as to extend from the tapered surfaces 25*a* and 25*b* to their respective free ends of the movable contact member 2. Reference numerals 27 denote movable contact portions that protrude from the bottom of the free ends of the movable contact member 2.

The cam member 3 is made of, for example, synthetic resin. As shown in FIGS. 10A to 10D, the cam member 3 has a disk-shaped base 31; a pair of holding protrusions 32 for fitting thereto the lower end of the coil spring 4 in order to hold the coil spring 4; a rectangular slit 33, which is formed between the pair of holding protrusions 32 on the base 31, for inserting therein the switching driver portion of the cam shaft 5; a rockably supporting portion formed by an arcuate cross-section recessed portion 34, which extends from one side to the other side of the slit 33, and by tapered portions 35, which extend in a tangential direction from both edges of the recess 34; protrusions 36 with the tapered portions 35; and chamfered portions 37 formed at the lower portions of the free ends of the base 31.

The cam member 3 is assembled with the movable contact member 2 by placing the recessed portion 34 of the rockably supporting portion at the lower surface of the cam member 3 onto the top end of the rockably supporting protrusions 23 of the movable contact member 2. Accordingly, the cam member 3 is rockably supported at the top ends of the rockably supporting protrusions 23 of the movable contact member 2. The cam member 3 can rock to the extent allowed by the striking of the tapered portions 25 with respect to the side surfaces of the rockably supporting protrusions 23.

The upper case portion 8 is formed by molding synthetic resin. As shown in FIGS. 8A to 8D, the upper case portion 8 has a cylindrical portion 81 for vertically guiding the plunger 6; restricting bar-like portions 82, which protrude from the inner peripheral face of the cylindrical portion 81, for restricting the rotation of the plunger 6 in the peripheral direction; an opening 83, formed in the top surface of the cylindrical portion 81, for allowing the upper portion of the plunger 6 to protrude outside the upper case portion 8; a flange 84 which is formed at the bottom end of the cylindrical portion 8 and brought onto the top surface of the lower case portion 1; and bosses 86 which protrude from the bottom surface of the flange 84. The case is formed by the upper case portion 8 and the lower case portion 1.

The plunger 6 is formed by molding synthetic resin. As shown in FIGS. 9A to 9E, the plunger 6 comprises a cylindrical operating portion 61 which protrudes from the opening 83 of the upper case portion 8; a cylindrical portion 62 which is formed at the bottom end of the operating portion 61, has a larger outside diameter than the operating portion 61, andt has an opening at the bottom surface thereof; guide grooves 63, which are formed in the cylindrical portion 62 along the axial direction thereof, for fitting thereto the restricting protruding bar-like portions 82 of the upper case 8; a neutral position supporting portion 64 for supporting the cam shaft 5 at the neutral position, with the inside bottom surface of the cylindrical portion 62 serving as a horizontal surface; a cam shaft guiding groove 65, which is formed at the inside bottom surface of the cylindrical portion 62, for rockably inserting therein the upper end of the cam shaft 5 in order to maintain the rockable surface of the cam shaft 5 in a plane.

The cam shaft 5 is formed by molding synthetic resin. As shown in FIGS. 7A and 7B, the cam shaft 5 comprises a guide plate 51 which is inserted into the cam shaft guiding groove 65 of the plunger 6; horizontal surfaces 52 which are press-contacted against the neutral position supporting portion 64 of the plunger 6 in order to maintain the plunger 6 at the neutral position; receiver portions 54 for receiving the upper end of the coil spring 4; a switching driver portion 55 with a pair of tapered surfaces 55*a* and 55*b* at the lower end of the cam shaft 5. Downwardly from the receiver portions 54, the plunger 6 tapers gradually from wide to narrow. As shown in FIG. 7B, the cam shaft 5 is composed of a planar plate whose front surface and back surface are parallel to each other, and is formed to a thickness that allows it to be fitted into the cam shaft guiding groove 65 and to rotate.

The guide plate portion 51 of the cam shaft 5 is inserted into the cam shaft guiding groove 65 of the plunger 6, while the horizontal surfaces 52 of the cam shaft 5 are pushed towards the neutral position supporting portions 64 by the force of the coil spring 4. Therefore, as shown in FIGS. 1 and 5, when the push button device is in a not pushed down state (or to be more exact when the cam shaft 5 is in a "not rotated state"), the cam shaft 5 is at the neutral position, that is the horizontal surfaces 52 are kept in contact with the neutral position supporting portions 64 by the force of the coil spring 4. When downward movement of the plunger 6 causes downward movement of the cam shaft 5, the switching driver portion 55 strikes the switching guide protrusion 24 of the movable contact member 2, the cam shaft 5 is rotated in accordance with the tilting direction of the movable contact member 2. This causes the switching driver portion 55 to slide on the movable contact member 2, and the downward force used to push down the plunger 6 acts to tilt the movable contact member 2 through the switching driver portion 55.

A description will now be given of the operation of the embodiment of the push switch device with reference to FIGS. 1 to 5.

When the push switch device is in a not pushed down state as shown in FIG. 1, the cam shaft 5 and the plunger 6 are pushed upward to the uppermost position by the force of the coil spring 4. The horizontal surfaces 52 of the cam shaft 5 are kept in contact with the neutral position supporting portion 64 by the force of the coil spring 4. When the horizontal surfaces 52 are at the neutral position, the cam shaft 5, shown in FIG. 1, is said to be in the neutral position. The switching driver portion 55 of the cam shaft 5 is separated from the movable contact member 2.

When the push switch device is in the not pushed down state, the left end of the movable contact member 2 is tilted downward with the rotational shaft portions 21 as center. The cam member 3, which is rockably supported on the rockably supporting protrusions 23 located on the top surface of the movable contact member 2, has its right end tilted downward. The coil spring 4, which is compressed between the cam member 3 and the plunger 6, is bent towards the right. Therefore, the force at the bottom end of the coil spring 4 acts slightly leftwards from a line extending directly below the coil spring 4, whereby the force of the coil spring 4 acts to push the rockably supporting protrusions 23 of the movable contact member 2 towards the left, via the recess 34, the right tapered portion 35, etc., of the cam member 3, causing the movable contact member 2 to be biased counterclockwise with the rotational shaft portions 21 as center. Accordingly, the movable contact member 2 is biased in the direction in which it is tilted, whereby the left movable contact portion 25 and the associated stationary contact (now shown) are kept in contact with each other. Since the movable contact member 2 is tilted downward at the left side, the right tapered surface 25*b* of the switching guide protrusion 24 is positioned on the path of movement of the switching driver portion 55 of the cam shaft 5.

When the plunger is pushed downward from its not pushed down state in FIG. 1, the plunger, while compressing the coil spring 4 through the cam shaft 5 and allowing the cam shaft 5 to be kept at the neutral position, moves downward and through the slit 33, as shown in FIG. 2. In the plunger state of FIG. 2, the switching driver portion 55 at the lower end of the downwardly moved cam shaft 5 is shown as having just struck the right tapered surface 25*b* of the switching guide protrusion 24 of the movable contact member 2.

When the plunger 6 is pushed further downward against the force of the coil spring 4 from its state in FIG. 2, the switching driver portion 55 of the cam shaft 5 is guided by the tapered surface 25*b* of the switching guide protrusion 24 and moves to the right, causing the cam shaft 5 to rock counterclockwise with the end of the horizontal surfaces 52 thereof as center. The switching driver portion 55 of the cam shaft 5 slides towards the raised free end (in FIG. 2) of the movable contact member 2, while pushing the recess 26 in the movable contact member 2. The force used to push down the plunger is used by the movable contact member 2, through the cam shaft 5, to switch contact connections. When the force, exerted onto the movable contact member 2 from the cam shaft 5, becomes greater than the biasing force of the coil spring 4 which biases the movable contact member 2, in this case, in the counterclockwise direction, the movable contact member 2 rotates clockwise with the rotational shaft portions 21 as center, and the plunger 6 is completely pushed down as shown in FIG. 3. When the plunger 6 is being pushed down to its completely pushed down position, the rockably supporting protrusions 23 are swung towards the right, causing the cam member 3 to also move towards the right. As a result, the coil spring is bent towards the left, and the cam member 3, which is supported by the rockably supporting protrusions 23, tilts towards the left. The left tapered portion 35 strikes a side face of its associated rockably supporting protrusion 23 and the switching driver portion 55 strikes a corner of the recess 26, whereby the plunger 6 is completely pushed down as shown in FIG. 3. Since the force of the lower end of the coil spring 4 acts slightly rightwards from a line extending directly below the coil spring 4, the force of the coil spring 4 acts to push the rockable supporting protrusions 23 of the movable contact member 4 towards the right, via the recess 34, the left tapered portion 35, etc., of the cam member 3. This causes the movable contact member 2 to be biased clockwise with the rotational shafts 21 as center. It is to be noted that a tactile feel is obtained when the coil spring 4 is bent in the opposite direction.

When the plunger 6, in the completely pushed down state of FIG. 3, is no longer pushed, the plunger 6 and the cam shaft 5 are pushed upward by the force of the coil spring 4. Then, as shown in FIG. 4, the force of the coil spring 4 causes the cam shaft 5 to rock towards the neutral position. The switching driver portion 55 moves away from the switching guide protrusion 24 at the upper surface of the movable contact member 2. The force of the coil spring 4 causes the horizontal surfaces 52 of cam shaft 5 to rock clockwise until they are pushed against the neutral position supporting portions 64. Then, as shown in FIG. 5, the cam shaft 5 is restored back to its neutral position.

Even when the plunger 6 is restored back to its not pushed down state of FIG. 5, the force of the coil spring 4, as illustrated in FIG. 3, acts to rotate the movable contact member 2 clockwise, through the cam member 3. Therefore, the right movable contact portion 27 of the movable contact member 2 and the associated stationary contact (not shown) are kept in contact with each other.

In the foregoing description of the operation of the push switch device the description was started with the left side of the movable contact member being tilted downward, as shown in FIG. 1. When the right side of the movable contact member 2 is tilted downward, as shown in FIG. 5, the left tapered surface 25*a* of the switching guide protrusion 24 is located on the path of movement of the switching driver portion 55 of the cam shaft 5. When the plunger 6 is pushed downward, the movable contact member 2 is moved in the opposite direction from the aforementioned direction in order to restore the plunger 6 back to its position of FIG. 1.

According to the embodiment, the switch device is made more durable by stabilizing its operational mechanism as a result of simplifying the forms of its component parts. In addition, a movable contact member 2 with movable contacts that come into contact with and separate from their corresponding stationary contacts is employed, and the movable contact member 2 is biased in the direction in which it is tilted by the coil spring 4 and the cam member 3, so that wear does not occur. As a result, no powder due to wear is produced, the reby ensuring continued contact connection, and, in particular, eliminating contact failure caused by medium current, so that more reliable contacts can be provided. During switching operations, the force used to push down the plunger 6 acts on the movable contact member 2 through the cam shaft 5, so that the switching operation can be more reliably performed than in conventional push switch devices which perform switching operations using spring forces alone. Further, since the cam shaft 5 can be made relatively large without enlarging the push switch device as a whole, the problem of operational failure caused by deterioration of a small cam due to wear in conventional push switch devices occurs less frequently.

These are realized by virtue of the above-described structure of the push device including a stationary contact provided in the lower case portion 1; a movable contact member 2 provided with a movable contact 27 that comes into contact with and separates from the stationary contact; a plunger 6 that is supported at the upper case portion 1 and the lower case portion 8, so as to be pushable downward; and a cam shaft 5 rotatably disposed between the bottom surface of the plunger 6 and the movable contact member 2 and moving vertically as the plunger 6 moves vertically. The cam shaft 5 has a switching driver portion 55 at the lower portion thereof. The force used to push down the plunger 6 causes the switching driver portion 55 to push down the movable contact member 2 and tilt it as the switching driver portion 55 slides on the movable contact member 2. The structure of the push switch device also includes a switching guide protrusion 24, which protrudes from substantially the center of the upper surface of the movable contact member 2, for always guiding the switching driver portion 55 of the cam shaft 5 towards the raised end of the movable contact member 2, in accordance with the direction in which the movable contact member 2 is tilted; a coil spring 4 for biasing the cam shaft 5 so that the cam shaft 5 is automatically restored back to its neutral position and for biasing the plunger 6 upward through the cam shaft 5; and a cam member which is rockably supported by the movable contact member 2, the cam member receiving the lower end of the coil spring 4 and tilting in a direction that is opposite to the direction in which the movable contact member 2 tilts in order to bend the coil spring. In the structure, when the plunger 6 is pushed down, the cam shaft 5, while being kept at the neutral position, moves downward. This causes the switching driver portion 55 of the cam shaft 5 to be guided by the tilted switching guide protrusion 24 towards the raised end of the movable contact member 2 and the cam shaft to move against the biasing force of the coil spring 4 and rotate. The rotation of the cam shaft 5 causes the switching driver portion 55 to push down the raised end of the movable contact member 2 and tilt it, and, at the same time, the cam member 3 to be tilted in a direction opposite to the direction in which the movable contact member 2 is tilted, causing the coil spring 4 to be bent in order to bias the movable contact member 2 in the direction in which the movable contact member 2 tilts.

According to one aspect of the present invention, the switch device is made more durable by stabilizing its operational mechanism as a result of simplifying the forms of its component parts. In addition, a movable contact member 2 with movable contacts that come into contact with and separate from their corresponding stationary contacts is employed, and the movable contact member 2 is biased in the direction in which it is tilted by the coil spring 4 and the cam member 3, so that wear does not occur. As a result, no powder due to wear is produced, thereby ensuring continued contact connection, and, in particular, eliminating contact failure caused by medium current, so that more reliable contacts can be provided. During switching operations, the force used to push down the plunger 6 acts on the movable contact member 2 through the cam shaft 5, so that the switching operation can be more reliably performed than in conventional push switch devices which perform switching operations using spring forces alone. Further, since the cam shaft 5 can be made relatively large without enlarging the push switch device as a whole, the problem of operational failure caused by deterioration of a small cam due to wear in conventional push switch devices occurs less frequently.

What is claimed is:

1. A push switch device, comprising:

a stationary contact disposed at a case;

a movable contact member which is rotatably supported at the case, said movable contact member having a movable contact which comes into contact with and separates from the stationary contact;

a plunger which is supported at the case so as to be pushable downward;

a cam shaft which is rotatably disposed between the lower surface of said plunger and said movable contact member, and which moves vertically as said plunger moves vertically, said cam shaft having at the lower portion thereof a switching driver portion, said switching driver portion sliding on said movable contact member so that the force used to push down said plunger causes the switching driver portion to push down and tilt said movable contact member as said cam shaft slides on said movable contact member;

a switching guide protrusion, disposed at substantially the center of the upper surface of said movable contact member, for always guiding the switching driver portion of said cam shaft towards the raised end of said movable contact member, in accordance with the direction in which said movable contact member is tilted;

a coil spring for biasing said cam shaft to automatically restore said cam shaft to a neutral position thereof, and for biasing said plunger upward through said cam shaft; and a cam member which is rockably supported on said movable contact member, said cam member receiving the lower end of said coil spring and tilting in a direction opposite to the direction in which said movable contact member tilts in order to bend said coil spring;

wherein when said plunger is pushed down, said cam shaft, while being kept at the neutral position, moves downward, causing the switching driver portion to be guided, by said switching guide protrusion which is tilted, towards the raised end portion of said movable contact member and said cam shaft to rotate against the biasing force of said coil spring, so that the rotation of said cam shaft causes the switching driver portion to push down the raised end portion of said movable contact member and tilt said movable contact member, and, at the same time, said cam member to tilt in a direction opposite to the direction in which said movable contact member tilts, causing said coil spring to bend in order to bias said movable contact member in the direction in which said movable contact member tilts.

* * * * *